United States Patent [19]

Näsman et al.

[11] Patent Number: 4,531,892

[45] Date of Patent: Jul. 30, 1985

[54] APPARATUS FOR PUMPING OF PULP

[75] Inventors: Lars E. Näsman, Alnö ; Alf I. Lindström, Sundsbruk, both of Sweden

[73] Assignee: Sunds Defibrator Aktiebolag, Sundsvall, Sweden

[21] Appl. No.: 577,827

[22] Filed: Feb. 7, 1984

[30] Foreign Application Priority Data

Mar. 14, 1983 [SE] Sweden ..... 8301360

[51] Int. Cl.[3] ..... F04B 23/14; F10B 3/00

[52] U.S. Cl. ..... 417/205; 417/900; 415/71

[58] Field of Search ..... 417/205, 206, 900, 199 R, 417/203; 415/71, 72

[56] References Cited

U.S. PATENT DOCUMENTS 475,826 5/1892 Street et al. ..... 415/72

3,059,862 10/1962 Rich ..... 417/203

3,087,435 4/1963 Boucher ..... 415/72

3,708,249 1/1973 Luthi ..... 417/205

3,716,304 2/1973 Coles ..... 417/900

4,156,392 5/1979 Bayeh ..... 415/72

FOREIGN PATENT DOCUMENTS 517337 6/1926 Fed. Rep. of Germany ..... 417/900

*Primary Examiner*—Cornelius J. Husar

*Assistant Examiner*—Peter M. Cuomo

*Attorney, Agent, or Firm*—Burns, Doane, Swecker & Mathis

[57] ABSTRACT

The apparatus comprises a centrifugal pump (1) fed by a screw feeder (8). The screw feeder comprises a screw (9) with a partially open thread (11). The screw (9) is driven separately in opposed direction to and with a lower speed than the impeller (3) of the pump (1). By this arrangement pulp of high concentration can be pumped.

4 Claims, 1 Drawing Figure

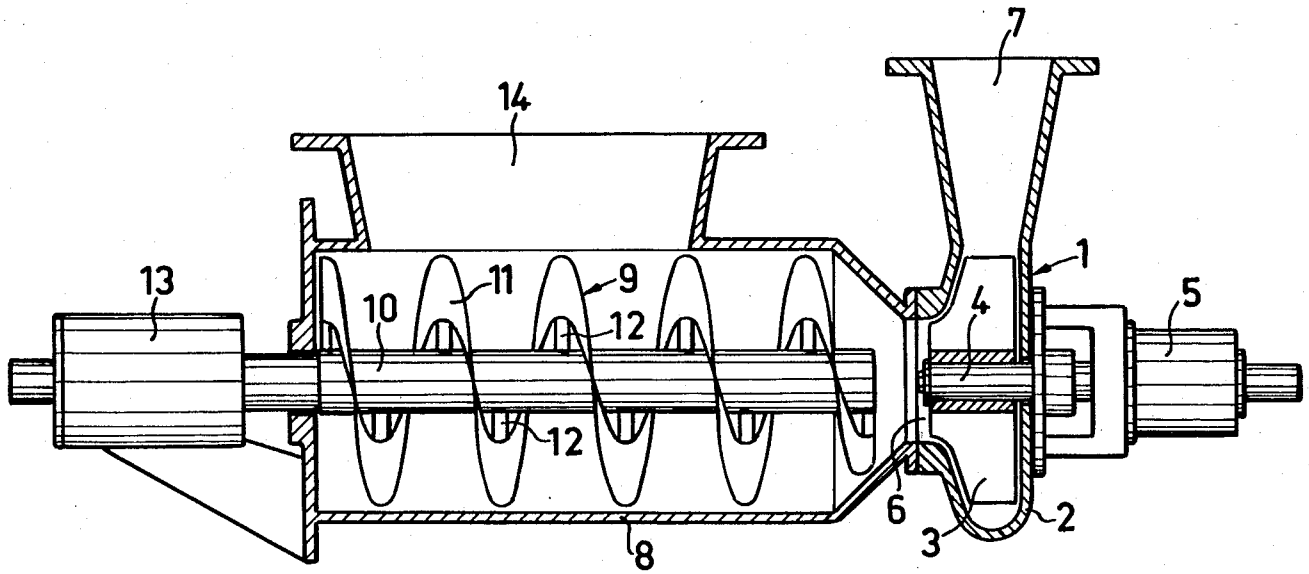
5
1
2
7
4
3
6
8
9
12
12
14
11
10
13

APPARATUS FOR PUMPING OF PULP

This invention relates to the pumping of pulp and, more precisely, refers to an apparatus intended especially for the pumping of pulp of high concentration.

Pulp of high concentration, above about 6%, usually is pumped by means of a so-called thick stock pump, which in principle is a gear type pump. Due to high requirements on precision in respect of the design and sealing of the impellers, these pumps are very expensive.

Centrifugal pumps cannot simply be used for the pumping of pulp at high concentration, because of clogging problems. It was tried to solve these problems by fluidizing the pulp before the pump by means of a rotor. The problems, however, were solved only partially thereby, and the risk of pump clogging still remains.

According to the present invention, the flow through the pump is ensured by means of a screw feeder, the screw of which has a partially open thread as set forth in the attached claims.

The characterizing features of the invention become apparent from the claims.

The invention is described in greater detail in the following, with reference to the accompanying FIGURE showing an embodiment of the invention.

The apparatus comprises a centrifugal pump 1 with a pump housing 2 enclosing an impeller 3. The impeller 3 is attached on a shaft 4, which is driven by a motor 5. The pump housing 2 includes a central inlet 6 and outlet 7. A screw feeder 8 connected to the inlet 6 comprises a screw 9 in the form of an axle 10 with a substantially continuously extending screw thread 11 attached on the axle by distance members 12, so that the screw thread leaves an opening in axial direction closest to the axle 10. A motor 13 drives the screw 9. An opening 14 in the screw feeder 8 is intended for the supply of the material to be pumped.

The screw feeder 8 has a diameter, which substantially exceeds the diameter of the pump inlet 6. The transition from the great diameter of the screw feeder down to the pump inlet can be continuous or discontinuous. Preferably, however, it is formed with a substantially conic surface so that the area decreases successively.

The motors 5 and, respectively, 13 are capable to drive the impeller 3 and, respectively, screw 9 with different numbers of revolutions and preferably in opposed directions. The impeller 3, thus, shall be driven with a relatively high number of revolutions, for example 1500–3000 rpm, while the screw 9 shall be driven with a relatively low number of revolutions, for example 100–600 rpm.

Pulp of high concentration is supplied through the opening 14 in the screw feeder 8. The supply can take place at atmospheric pressure, and the pulp is advanced all the way to the supply opening 14 by an open conveyor. In the screw feeder 8 the pulp is moved to the pump inlet 6 by the screw 9. The capacity of the screw is adjusted so as to exceed the capacity of the pump. Thereby a certain recirculation of pulp through the open portion of the screw between the screw thread 11 and axle 10 is effected. At the same time also an overpressure is obtained on the inlet side of the pump. When the screw 9 is driven in opposed direction to the impeller 2, best possible conditions are created in the pump inlet 6. According to the embodiment shown, the transition from the screw feeder 8 to the pump inlet 6 is conic, but also may have a different configuration. The pump inlet 6, for example, may be located eccentrically in relation to the axle of the screw feeder 8. The area reduction even may take place abruptly.

The aforesaid arrangement brings about so favourable conditions in the pulp; that it proved possible to pump pulp of high concentration, up to at least 18%, with a centrifugal pump.

The invention, of course, is not restricted to the embodiment shown, but can be varied within the scope of the invention idea.

We claim:

1. An apparatus for pumping pulp of high concentration, comprising:

a cenrifugal pump having a rotary impeller positioned between an inlet and an outlet of said pump, a screw conveyor mounted for rotation independently of said pump and including a screw arranged to advance pulp toward a discharge end of said screw conveyor, said discharge end being arranged in communication with said inlet of said pump, said screw comprising a partially open thread to permit a partial recirculation of the pulp, said screw having a transport capacity exceeding that of said pump, so that said partial recirculation of pulp is induced, the cross-sectional area of said discharge end of said screw conveyor being substantially greater than said pump inlet, means for rotating said pump impeller, and means for rotating said screw at a slower rate than said pump impeller.

2. An apparatus as defined in claim 1, characterized in that the screw and impeller are driven in opposed directions.

3. An apparatus as defined in claim 2, characterized in that the thread of the screw is continuous and located spaced from the axle of the screw.

4. An apparatus as defined in claim 1, characterized in that the thread of the screw is continuous and located spaced from the axle of the screw.

* * * * *